US006701766B2

(12) United States Patent
Halleck et al.

(10) Patent No.: US 6,701,766 B2
(45) Date of Patent: Mar. 9, 2004

(54) PLATE-STRETCHING GRIP HEAD

(75) Inventors: Günter Halleck, Krefeld (DE); Andreas Scholzen, Moers (DE); Wilfried Just, Duisburg (DE)

(73) Assignee: SMS Meer GmbH, Monchengladbach (DE)

( * ) Notice: Subject to any disclaimer, the term of this patent is extended or adjusted under 35 U.S.C. 154(b) by 0 days.

(21) Appl. No.: 10/102,303

(22) Filed: Mar. 20, 2002

(65) Prior Publication Data

US 2002/0134129 A1 Sep. 26, 2002

(30) Foreign Application Priority Data

Mar. 21, 2001 (DE) ..... 101 13 668

(51) Int. Cl.[7] ..... B21D 25/04
(52) U.S. Cl. ..... 72/302; 72/295
(58) Field of Search ..... 72/302, 301, 295, 72/311

(56) References Cited

U.S. PATENT DOCUMENTS 2,727,556 A * 12/1955 Albers ..... 72/302
2,908,316 A * 10/1959 Albers ..... 72/302
4,497,193 A * 2/1985 Kutz et al. ..... 72/302

FOREIGN PATENT DOCUMENTS

DE 32 05 701 10/1982
DE 36 33 480 12/1987

* cited by examiner

*Primary Examiner*—Daniel C. Crane
(74) *Attorney, Agent, or Firm*—Herbert Dubno; Andrew Wilford

(57) ABSTRACT

A metal-stretching grip head has a row of parallel upper plates wholly to one side of a plane and having front ends and rear ends and a row of parallel lower plates wholly to an opposite side of the plane and having front ends forming at the plane with the front ends of the upper plates a mouth slot extending along the plane and open forwardly on the plane. The lower plates also have rear ends juxtaposed across the plane with the upper-plate rear ends. A one-piece C-section metal bar is snugly received in the mouth slot. Rigid structure separate from the plates and bar fixes the plates relative to one another.

7 Claims, 2 Drawing Sheets

PLATE-STRETCHING GRIP HEAD

FIELD OF THE INVENTION

The present invention relates to a grip head for stretching or straightening a flat or plate-like workpiece.

BACKGROUND OF THE INVENTION

A standard grip head or plyer as described in German patent document 3,205,701 of H. Kutz has a row of one-piece plates extending parallel to each other and symmetrical to both sides of a normally horizontal symmetry plane. The plates are identical and are each formed with a forwardly open mouth or cutout into which the edge of a plate workpiece is inserted and where it is wedged in place against a pair of separate liner bars fitted to the opposite edges of the mouth. Rear ends of the plates are welded to a pair of rigidifying beams carried by a hydraulic structure that pulls the head back parallel to the plane to stretch and/or straighten the workpiece whose edge is wedged in the mouth.

This system is quite simple and relatively effective. The plates are extremely rigid in their planes and the liner bars transmit the forces tending to spread the mouth to all the plates. The central plates are extra thick to compensate for the forces concentrated there, in particular when a narrow workpiece is being clamped. Nonetheless the device is extremely bulky and very heavy.

Another system described in German patent 3,633,480 of K. Claasen sandwiches the mouth-forming plates between a pair of rigid beams extending parallel to the mouth and the stack of plates. Thus this plyer can grip a relatively narrow workpiece. It also is, however, very heavy and bulky. The plates are forged and massive and the external beams are normally cast and very heavy.

OBJECTS OF THE INVENTION

It is therefore an object of the present invention to provide an improved plate-stretching or -straightening grip head.

Another object is the provision of such an improved plate-stretching or -straightening grip head which overcomes the above-given disadvantages, that is which is extremely strong but that is still relatively compact.

A further object is to make such a grip head or plyer that can be assembled or serviced in the field.

SUMMARY OF THE INVENTION

A metal-stretching grip head has according to the invention a row of parallel upper plates wholly to one side of a plane and having front ends and rear ends and a row of parallel lower plates wholly to an opposite side of the plane and having front ends forming at the plane with the front ends of the upper plates a mouth slot extending along the plane and open forwardly on the plane. The lower plates also have rear ends juxtaposed across the plane with the upper-plate rear ends. A one-piece C-section metal bar is snugly received in the mouth slot. Rigid structure separate from the plates and bar fixes the plates relative to one another.

This sandwich construction makes it possible to assemble and service the unit in the field. In addition the C-section mouth bar is made of one piece, e.g. of forged steel, so it is very strong in and of itself, making the entire grip head very rigid. The plates themselves can be made of stiff but inexpensive sheet metal, making the assembly light and inexpensive at no reduction in strength.

The structure in accordance with the invention includes upper and lower rear beams engaging upper and lower edges of the upper and lower plates rearward of the mouth slot, and tie bolts extending across the plane between the rear beams. Spacers are provided between the beams. In addition a steel spacer box is provided between the upper and lower plates rearward of the mouth slot. The plane bisects the spacer box.

The head can also have upper and lower front beams engaging upper and lower edges of the upper and lower plates level with the mouth slot and tie bolts extending across the plane between the front beams.

BRIEF DESCRIPTION OF THE DRAWING

The above and other objects, features, and advantages will become more readily apparent from the following description, reference being made to the accompanying drawing in which.

SPECIFIC DESCRIPTION

Figure 2:
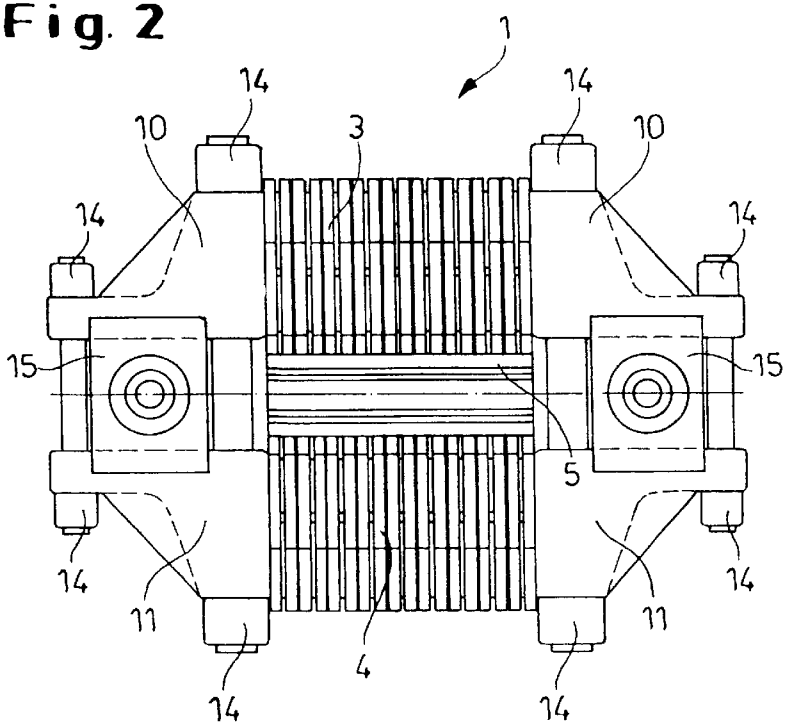
FIG. 2 is a front view of the grip head.
Figure 1:
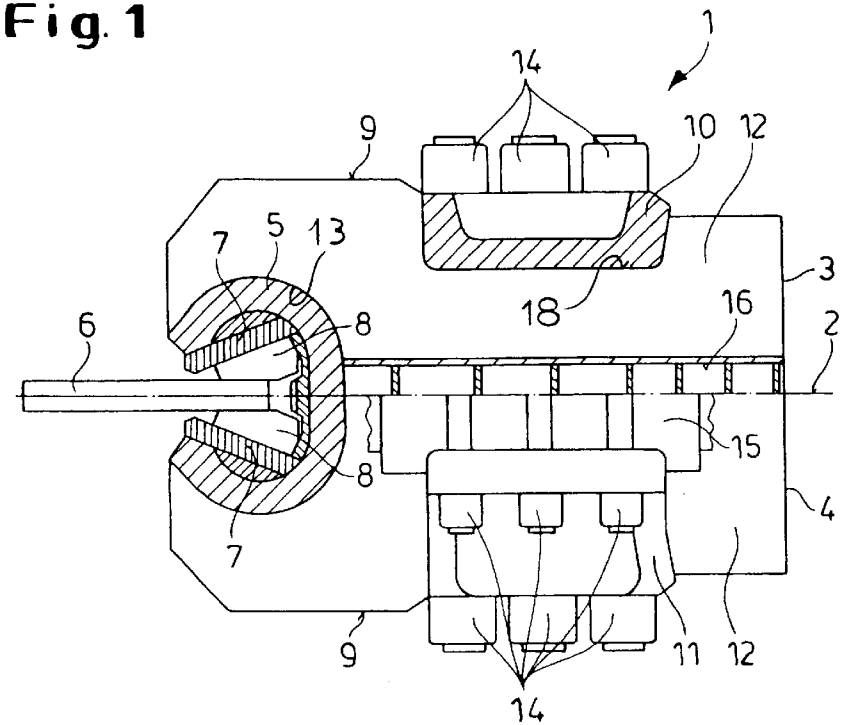
FIG. 1 is a partly sectional side view of the grip head according to the invention.

As seen in FIGS. 1 and 2 a grip head 1 is basically symmetrical to a normally horizontal plane 2 and has a row of upper sheet-metal plates 3 to one side of this plane 2 and an identical row of lower plates 4 to the opposite side. The plates 3 and 4 are all flat and lie in respective parallel planes perpendicular to the plane 2. Together they form a forwardly open mouth slot 13 symmetrical to the plane 2. A one-piece forged C-section bar 5 sits in the slot 13 and is adapted to hold a flat workpiece 6. Wedge bars 7 and 8 extending parallel to the form secure the edge of the workpiece 6 in the mouth bar 5.

Each of the plates 3 and 4 has a wide front end 9 forming the respective half of the mouth slot 13 holding the bar 5 and a narrower rear end 12. Central upwardly and downwardly open grooves in the plates 3 and 4 receive respective upper and lower forged brace beams 10 and 11 extending parallel to the plane 2 and to the mouth bar 5. A pair of box-shaped spacers 15 are provided between the outer ends of the beams 10 and 11 and another box-like steel spacer 16 between the plates 3 and 4. Tie bolts 14 extending perpendicular to the plane 2 between the beams 10 and 11 secure the assembly tightly together.

The use of separate plates or plate halves 3 and 4, allows a one-piece mouth bar 5 to be employed. This makes the device very strong and still quite compact. No welding is necessary for the plates 3 and 4 so the entire device can be assembled or repaired easily in the field.

Figure 4:
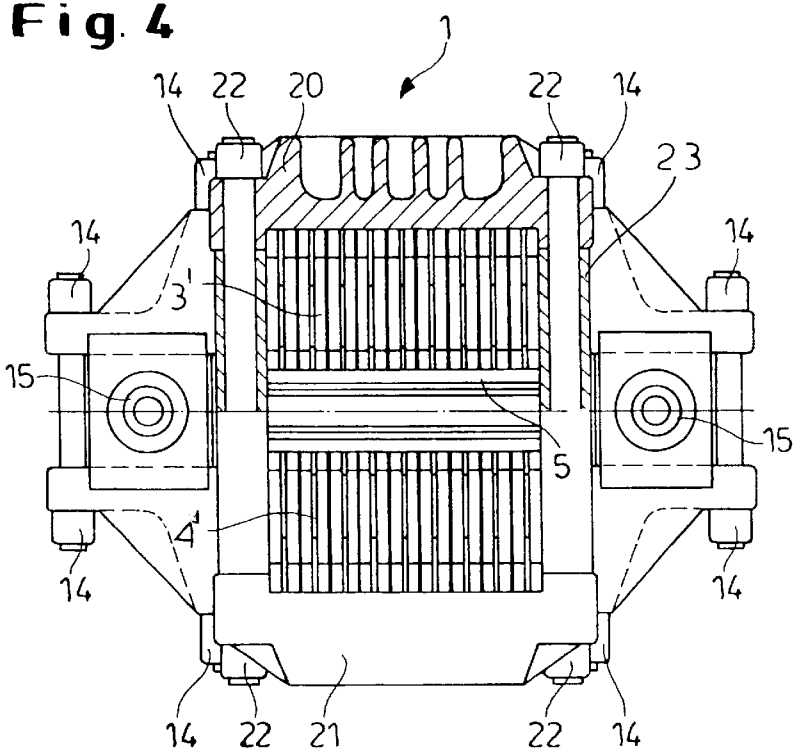
FIG. 4 is a partly sectional front view of the grip head of FIG. 3.
Figure 3:
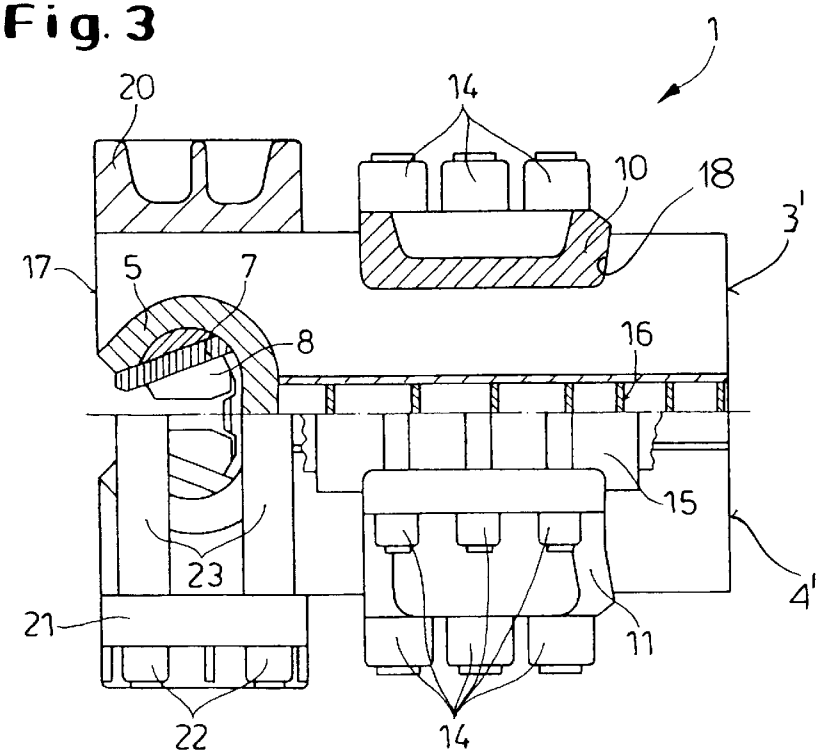
FIG. 3 is a view like FIG. 1 of another grip head in accordance with the invention.

The arrangement of FIGS. 3 and 4 is substantially identical to that of FIGS. 1 and 2 except that the plates 3' and 4' do not have enlarged front ends 9 and two further beams 20 and 21 are provided at the front ends, flush with front faces 17 thereof. Tie bolts 22 and spacer tubes 23 extending across the plane 2 secure the front beams 20 and 21 together, making the assembly extremely rigid.

We claim:

1. A metal-stretching grip head comprising:

a row of parallel upper plates wholly to one side of a plane and having front ends and rear ends;

a row of parallel lower plates wholly to an opposite side of the plane and having front ends forming a mouth slot at the plane with the front ends of the upper plates, the mouth slot extending along the plane and open forwardly on the plane, the lower plates having rear ends juxtaposed across the plane with the upper-plate rear ends;

a one-piece C-section metal bar snugly received in the mouth slot, generally bisected by the plane, and extending along the plane a full length of the mouth slot; and rigid structure separate from the plates and bar and fixing the plates relative to one another.

2. A metal-stretching grip head comprising:

a row of parallel upper elates wholly to one side of a plane and having front ends and rear ends;

a row of parallel lower plates wholly to an opposite side of the plane and having front ends forming a mouth slot at the plane with the front ends of the upper plates, the mouth slot extending along the plane and open forwardly on the plane, the lower plates having rear ends juxtaposed across the plane with the upper-plate rear ends;

a one-piece C-section metal bar snugly received in the mouth slot;

rigid structure separate from the plates and bar and fixing the plates relative to one another;

upper and lower rear beams engaging upper and lower edges of the upper and lower plates rearward of the mouth slot; and tie bolts extending across the plane between the rear beams.

3. The grip head defined in claim 1 wherein the structure further includes spacers between the beams.

4. The grip head defined in claim 1, further comprising a spacer box between the upper and lower plates rearward of the mouth slot, the plane bisecting the spacer box.

5.A metal-stretching grip head comprising:

a row of parallel upper plates wholly to one side of a plane and having front ends and rear ends;

a row of parallel lower plates wholly to an opposite side of the plane and having front ends forming a mouth slot at the plane with the front ends of the upper plates, the mouth slot extending along the plane and open forwardly on the plane, the lower elates having rear ends juxtaposed across the plane with the upper-plate rear ends;

a one-piece C-section metal bar snugly received in the mouth slot;

rigid structure separate from the plates and bar and fixing the plates relative to one another;

upper and lower front beams engaging upper and lower edges of the upper and lower plates level with the mouth slot; and tie bolts extending across the plane between the front beams.

6. The grip head defined in claim 1 wherein the plates are made of sheet metal, all of the upper plates are identical, and all of the lower plates are identical.

7. The grip head defined in claim 6 wherein the mouth bar is forged.

* * * * *